US009731543B2

(12) United States Patent
Laemle

(10) Patent No.: US 9,731,543 B2
(45) Date of Patent: Aug. 15, 2017

(54) DECORATIVE INSERT

(71) Applicant: David A. Laemle, Westwood, NJ (US)

(72) Inventor: David A. Laemle, Westwood, NJ (US)

(73) Assignee: Davro Products, Inc., Westwood, NJ (US)

( * ) Notice: Subject to any disclaimer, the term of this patent is extended or adjusted under 35 U.S.C. 154(b) by 563 days.

(21) Appl. No.: 13/933,760

(22) Filed: Jul. 2, 2013

(65) Prior Publication Data

US 2015/0016859 A1 Jan. 15, 2015

(51) Int. Cl.

| | |
|---|---|
| ***B43K 29/00*** | (2006.01) |
| ***B43K 23/00*** | (2006.01) |
| ***B43K 5/00*** | (2006.01) |
| ***B43K 29/10*** | (2006.01) |
| ***B43K 5/17*** | (2006.01) |
| ***B43K 15/00*** | (2006.01) |
| ***A45D 40/00*** | (2006.01) |
| ***B43K 29/007*** | (2006.01) |
| ***B43K 7/00*** | (2006.01) |
| ***A45D 40/18*** | (2006.01) |

(52) U.S. Cl.

CPC ..... *B43K 15/00* (2013.01); *A45D 40/00* (2013.01); *A45D 40/18* (2013.01); *B43K 7/005* (2013.01); *B43K 29/00* (2013.01); *B43K 29/007* (2013.01); *A45D 2040/0006* (2013.01); *A45D 2040/0012* (2013.01); *A45D 2040/0025* (2013.01); *Y10T 29/49817* (2015.01); *Y10T 29/49826* (2015.01)

(58) Field of Classification Search

CPC ..... A45D 40/00; B43K 23/00; B43K 29/10; B43K 15/00

USPC ..... 401/195

See application file for complete search history.

(56) References Cited

U.S. PATENT DOCUMENTS

| | | | | |
|---|---|---|---|---|
| 1,368,262 | A * | 2/1921 | Johnson | B43K 21/08 401/2 |
| 4,585,364 | A * | 4/1986 | Liaw | B43K 29/087 346/143 |
| D387,088 | S * | 12/1997 | Tseng | D19/173 |
| 6,019,536 | A * | 2/2000 | Lee | B43K 5/005 40/334 |
| 6,273,627 | B1 * | 8/2001 | Mittersinker | B43K 5/17 401/109 |
| 6,375,376 | B1 * | 4/2002 | Hsu | B43K 23/08 401/195 |
| 6,471,433 | B1 | 10/2002 | Lee | |
| 6,915,554 | B2 * | 7/2005 | Yang | B29C 39/023 264/245 |

(Continued)

FOREIGN PATENT DOCUMENTS

EP 0456617 B1 11/1991

*Primary Examiner* — David Walczak
*Assistant Examiner* — Thomas M Abebe
(74) *Attorney, Agent, or Firm* — St. Onge Steward Johnston & Reens, LLC

(57) ABSTRACT

A writing instrument with a decorative element is provided including a housing having a first portion and a second portion, wherein at least one of the first and second housing portions has a recess positioned at a terminal edge thereof, and an decorative insert having a body and at least one decorative portion positioned on the body, the decorative portion having a shape that substantially corresponds to the shape of the recess such that only the decorative portion is visible when the first and second housing portions are connected together.

26 Claims, 10 Drawing Sheets

(56) References Cited

U.S. PATENT DOCUMENTS

| | | | | |
|---|---|---|---|---|
| 7,467,904 | B1 * | 12/2008 | Wager | B43K 5/005 401/195 |
| 7,600,938 | B2 * | 10/2009 | Kobayashi | B43K 1/088 401/188 A |
| 8,152,401 | B2 * | 4/2012 | Sokoloff | B43K 1/12 401/198 |
| 9,415,625 | B2 * | 8/2016 | Fisher | B43K 24/00 |
| 2003/0194257 | A1 * | 10/2003 | Collins | B43K 7/005 401/88 |
| 2004/0022574 | A1 * | 2/2004 | Huttner | B43K 29/007 401/88 |
| 2004/0062036 | A1 * | 4/2004 | Kuo | B43K 29/10 362/118 |
| 2005/0207822 | A1 * | 9/2005 | Wang | B43K 7/005 401/193 |
| 2005/0214062 | A1 * | 9/2005 | Asami | C09D 11/18 401/216 |
| 2006/0188321 | A1 * | 8/2006 | Nakamura | B43K 1/08 401/214 |
| 2006/0228155 | A1 * | 10/2006 | Butler | A45D 40/18 401/17 |
| 2008/0175650 | A1 * | 7/2008 | Geddes | B43K 23/001 401/195 |
| 2011/0116857 | A1 * | 5/2011 | Carroll | A45D 34/04 401/101 |
| 2011/0182649 | A1 * | 7/2011 | Rolion | B43K 21/003 401/55 |
| 2014/0093300 | A1 * | 4/2014 | Schwartzberg | B43K 29/00 401/195 |
| 2015/0071694 | A1 * | 3/2015 | Marino | B43K 1/02 401/2 |
| 2016/0176226 | A1 * | 6/2016 | Chatterton | A45C 11/18 24/67.11 |

* cited by examiner 28
30
32
14
10
18
12
24
26

28
30
32
10
14
16
18
22
20
12
24
26

DECORATIVE INSERT

FIELD OF THE INVENTION

The present invention relates to the field of providing decorative elements for various consumer products. In particular, the present invention relates to a customizable decorative element for a writing instrument, cosmetic packaging, and the like.

BACKGROUND OF THE INVENTION

Many of the everyday consumer products, such as pens, cosmetic products, etc., in addition to their primary purpose, may also be used for advertisement and marketing purposes. For example, pens having a company's logo may be distributed to potential customers at trade shows or other marketing events. It is, thereby, desirable to have an easy and cost effective way of customizing the products for a particular customer.

There are a number of existing systems and methods for providing decorative elements for pens. For example, U.S. Pat. No. 6,915,554 to Yang describes a process of molding and assembling a three-dimensional ornament for a pen. As shown in FIG. 8 of Yang, the pen includes a hollow tube with a cutout in the side wall corresponding to the shape of the molded ornament. A flexible molded cylindrical part with the ornament is fitted inside the hollow pen tube such that the ornament fits inside the cutout and protrudes from the outer surface of the pen. Then, a tubular sleeve in inserted inside the hollow pen tube to push the contact wall of the ornament against the wall of the hollow pen tube.

U.S. Pat. No. 6,471,433 to Lee describes a three-dimensional ring insert for a pen, which includes a pattern ring with through holes and a flexible insert with protrusions placed inside the pattern ring such that the protrusions extend out of the through holes. A liner ring is placed inside the pattern ring to sandwich the flexible insert between the wall of the pattern ring and the liner ring. A connector ring is further provided having a middle portion with a larger diameter corresponding to the outer diameter of the pen body. During the pen assembly, as shown in FIG. 2, one end of the assembled ring insert is screwed onto one pen part and the other end is force fitted onto the connector ring, which is in turn force fitted into the other pen part.

U.S. Pat. No. 6,019,536 to Lee describes a three-dimensional pattern insert for a pen cap, as best shown in FIG. 2. The pen cap has an opening in a sidewall corresponding to the shape of insert pattern. The insert is a flexible strip with a 3-dimensional pattern thereon, which is compressed and inserted inside the pen cap such that the patterns protrudes through the opening in the cap. A liner ring is then inserted into the pen cap to fix the insert in place between the cap wall and the liner ring.

European Patent No. 0456617 B1 to Stilolinea S. r. l. describes a decorative pen construct with different parts of the pen having different colors. As shown in FIGS. 1-3, the pen is constructed of a clip portion and a body portion, and a tubular connecting element connecting these portions together. The connecting element has a middle section in the form of a circular projection with a larger outer diameter. When the pen is assembled, each end of the connecting element is inserted into a corresponding pen portion such that the pen portions touch the middle section of the connecting element, and one end of the element extends out of the clip portion of the pen. The connecting element has a color that is different from the color of the pen portions and therefore, the visible portions of the connecting element provide a decorative effect.

However, the above discussed prior art systems suffer from a number of disadvantages. First, the prior art systems typically require additional parts in order to secure decorative inserts inside the pen once assembled, thereby making the manufacturing process more complex and costly. Furthermore, the prior art systems require specially manufactured pen parts with complicated cut-outs to accommodate the decorative inserts, and the inserts typically cannot be easily removed and replaced with a different insert once placed inside the pen.

What is desired, therefore, is an improved decorative insert that may be easily customized with any desirable decorative pattern and then used with already manufactured components, such as pen or cosmetic packaging components, thereby providing a custom-made but cost efficient product. What is further desired is an improved decorative insert that is very simple in design, without requiring additional parts or manufacturing steps for assembly with the product, thereby reducing manufacturing time and costs.

SUMMARY OF THE INVENTION

In order to address the shortcoming of the prior art systems and to achieve at least the above-mentioned objectives, a writing instrument with a decorative element is provided, including a housing having a first portion and a second portion, wherein at least one of the first and second housing portions has a recess positioned at a terminal edge thereof, and a decorative insert having a body and at least one decorative portion positioned on the body, the decorative portion having a shape that substantially corresponds to the shape of the recess such that only the decorative portion is visible when the first and second housing portions are connected together.

In some embodiments, the recess corresponds to only a portion of a periphery of the at least one decorative portion of the decorative insert.

In certain embodiments, the body of the decorative insert has a continuous unbroken annular portion. In some of these embodiments, the annular portion of the body of the decorative insert has a fixed outer diameter that is smaller than an inner diameter of at least one of the first housing portion and an inner diameter of the second housing portion, such that the body of the decorative insert fits inside at least one of the first housing portion and the second housing portion. In certain of these embodiments, the difference between the outer diameter of the body and the inner diameter of at least one of the first housing portion and the second housing portion is in a range from about one percent to about ten percent.

In certain embodiments, the first housing portion has a first recess positioned at a terminal edge thereof and the second housing portion has a second recess positioned at a terminal edge thereof such that first and second recesses align when the first and second housing portions are connected together. In some of these embodiments, the at least one decorative portion of the decorative insert has a shape that substantially corresponds to the shape of the first and second recesses when the recesses are aligned with each other.

In some embodiments, the at least one decorative portion has a top surface with a decorative pattern, the top surface being flush with an outer surface of the housing when the decorative insert is positioned between the first and second housing portions. In certain of these embodiments, the decorative pattern is printed on the top surface of the at least one decorative portion. In additional of these embodiments, the decorative pattern is three-dimensional. In further of these embodiments, the decorative pattern includes a corporate identifier.

In some advantageous embodiments, the writing instrument further includes a third housing portion having a recess positioned at a terminal edge thereof, and a second decorative insert having a body and at least one decorative portion positioned on the body, wherein at least a part of the decorative portion fits into the recess in the third housing portion such that only the decorative portion is visible when the second and third housing portions are connected together.

In some cases, the writing instrument further includes a first connector provided on the first housing portion and a second connector provided on the second housing portion, wherein the first and second connectors mate when the first and second housing portions are connected together.

In certain embodiments, the at least one decorative portion includes a first decorative portion and a second decorative portion positioned on the body, the least one of the first and second housing portions has a first recess positioned at a terminal edge thereof and a second recess positioned at the terminal edge thereof, and the first decorative portion has a shape that substantially corresponds to the shape of the first recess and the second decorative portion has a shape that substantially corresponds to the shape of the second recess such that only the first and second decorative portions are visible when the first and second housing portions are connected together.

A tubular member with a decorative insert is also provided, including a housing having a first portion and a second portion, wherein at least one of the first and second housing portions has a recess positioned at a terminal edge thereof, and a decorative insert having a body and at least one decorative portion positioned on the body, the decorative portion having a shape that substantially corresponds to the shape of the recess such that only the decorative portion is visible when the first and second housing portions are connected together.

In some embodiments, the tubular member is a writing instrument. In additional embodiments, the tubular member is a cosmetic product packaging.

A method for assembling a tubular member with a decorative element is further provided, including the steps of placing a decorative insert having a body and at least one decorative portion positioned on the body between a first housing portion of the tubular member and a second housing portion of the tubular member, positioning the decorative portion in a recess provided at a terminal edge of at least one of the first housing portion and the second housing portion, and connecting the first and second housing portions together such that only the decorative portion is visible.

In some embodiments, the recess corresponds to only a portion of a periphery of the decorative portion of the decorative insert.

In some embodiments, the at least one decorative portion has a top surface with a decorative pattern, the top surface being flush with an outer surface of the housing when the decorative insert is positioned between the first and second housing portions. In certain of these embodiments, the method further includes the step of printing the decorative pattern on the top surface of the at least one decorative portion. In additional embodiments, the decorative pattern is three-dimensional. In further of these embodiments, the method further includes the steps of selecting a corporate identifier having a shape that substantially corresponds to the shape of the decorative portion and transferring the corporate identifier onto the decorative portion.

In certain embodiments, the body of the decorative insert has a continuous unbroken annular portion with an outer diameter that is smaller than an inner diameter of at least one of the first housing portion and an inner diameter of the second housing portion, and the method further includes the step of inserting the body of the decorative insert inside at least one of the first housing portion and the second housing portion to retain the decorative insert between the first and second housing portions.

In some embodiments, the tubular member further includes a third housing portion having a recess positioned at a terminal edge thereof, and the method further includes the steps of placing a second decorative insert having a body and at least one decorative portion positioned on the body between the second and third housing portions, positioning at least a part of the decorative portion in the recess provided in the third housing portion, and connecting the second and third housing portions together such that only the decorative portion is visible.

In some cases, the step of connecting the first and second housing portions further includes engaging a first connector provided on the first housing portion with a second connector provided on the second housing portion.

In certain embodiments, the method further includes the steps of disconnecting the first and second housing portions, removing the decorative insert, inserting another decorative insert having at least one decorative portion between the first and second housing portions, and connecting the first and second housing portions together such that only the at least one decorative portion is visible.

Other objects of the invention and its particular features and advantages will become more apparent from consideration of the following drawings and accompanying detailed description.

DETAILED DESCRIPTION OF THE INVENTION

Figures 1A, 1B:
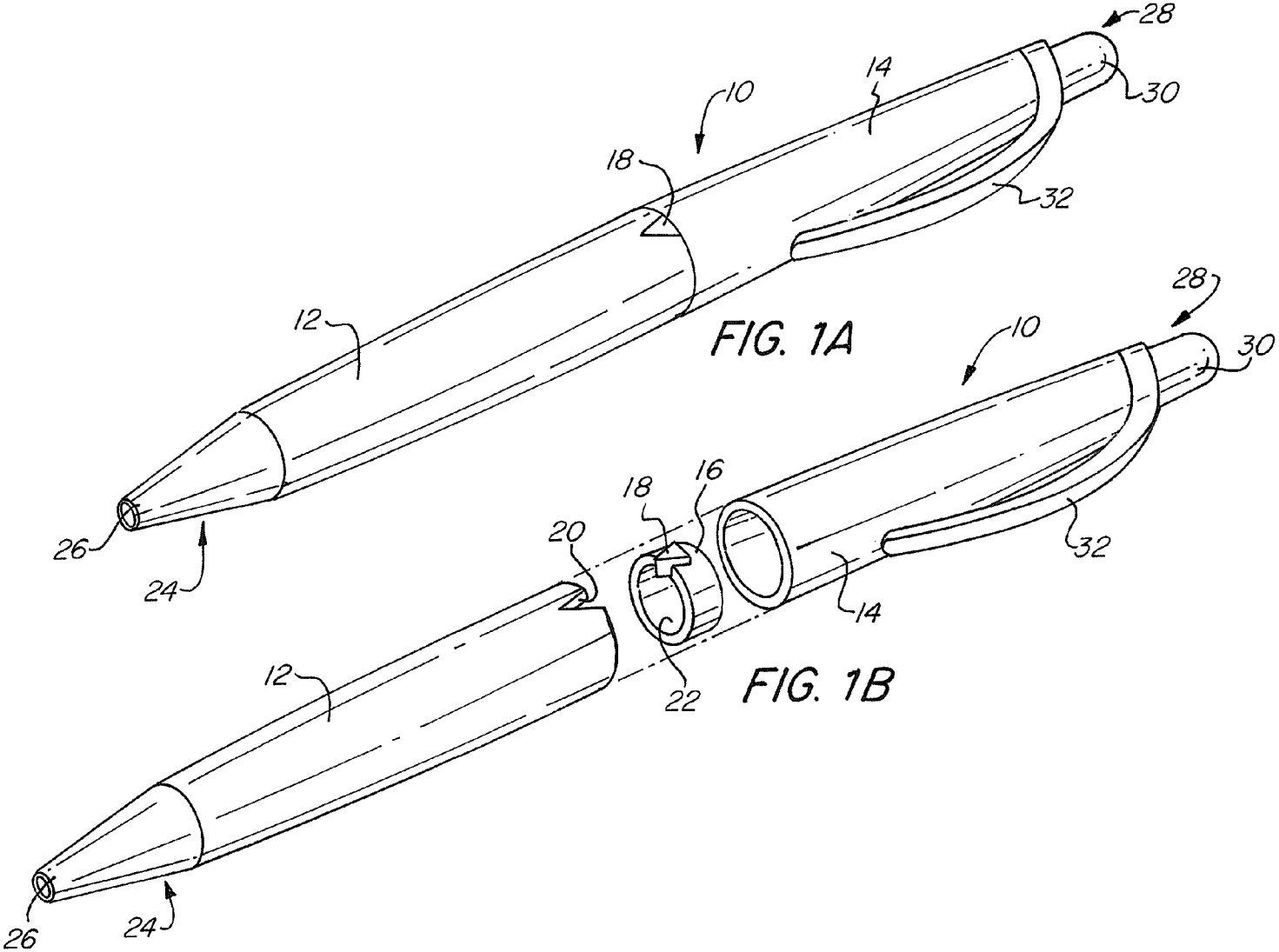
FIG. 1A is front perspective view of a writing instrument with a decorative insert in accordance with the present invention.
FIG. 1B is front perspective view of the writing instrument of FIG. 1A, shown in an exploded configuration.

The basic components of one embodiment of a writing instrument with a decorative insert in accordance with the invention are illustrated in FIG. 1. As used in the description, the terms "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which orientation is not necessary for achieving the objects of the invention.

The present invention is suitable for providing decorative elements for any type of a device that has a tubular body. In some exemplary embodiments, the present invention is used to decorate a writing instrument, such as a pen, and a cosmetic product packaging, in particular, lipstick housing. It is understood, however, that the present invention may be used to provide decorative effect to other types of packaging.

FIGS. 1A and 1B illustrate one exemplary embodiment of the present invention, wherein the tubular member is a pen. As shown in these figures, the pen (10) has a hollow housing, which includes a first housing portion (12) and a second housing portion (14). The housing portions (12, 14) are made with any suitable material, such as, e.g., plastic, metal, etc. The first and second housing portions (12, 14) accommodate a writing instrument, such as ink cartridge (not shown). A distal end (24) of the first housing portion (12) has an opening (26) through which the writing instrument is extended out when the pen is in use. The writing instrument may be extended out of the housing by pressing a button (30) provided at a proximal end (28) of the housing, which engages an actuator provided inside the housing and causes the writing instrument to extend out of the opening (26). It is understood that any suitable mechanism may be used to bring the writing instrument into an extended position.

The pen (10) further includes a coupling member, such as a clip (32), for attachment to a person's clothing or luggage to facilitate carrying of the pen (10) by the user. Any other suitable coupling member may be used in accordance with the present invention.

As shown in FIG. 1B, the pen (10) further includes a decorative insert (16). In the exemplary embodiment shown in this figure, the decorative insert (16) includes a continuous unbroken annular body (22) and a decorative portion (18) positioned on the annular body. The decorative insert is made with any suitable material. In some advantageous embodiments, the decorative insert (16) is made with a rigid material, such as metal or hard plastic, such that the annular body (22) has a fixed diameter. It is understood that the decorative insert (16) may have a body portion that does not extend around the entire circumference, but instead may be a half-circle, or any other suitable shape. It is further understood that the body portion of the decorative insert (16) may be made with a suitable semi-rigid or flexible material.

The first housing portion (12) has a recess (20) positioned at a terminal edge of a proximal end of the first housing portion and being open to the terminal edge, as shown in FIG. 1B. It is understood that the recess (20) may have any desirable shape and that the triangular shape shown in this figure is only exemplary. The recess (20) is made by any suitable method, such as cutting out a portion of the housing once the housing is molded, or during molding of the housing.

The decorative portion (18) of the decorative insert (16) has a shape that substantially corresponds to the shape of the recess (20) such that the decorative portion (18) fits inside the recess (20) when the two housing portions (12, 14) are connected together, as shown in FIG. 1A. Furthermore, the decorative portion (18) extends from the outer surface of the body (22) of the decorative insert (16), such that, when the decorative insert (16) is inserted between the first and second housing portions (12, 14), the top surface of the decorate portion (18) is flush with the outer surface of the pen housing, as illustrated in FIG. 1A. Such design gives the pen an esthetically pleasing appearance.

Figure 2A:
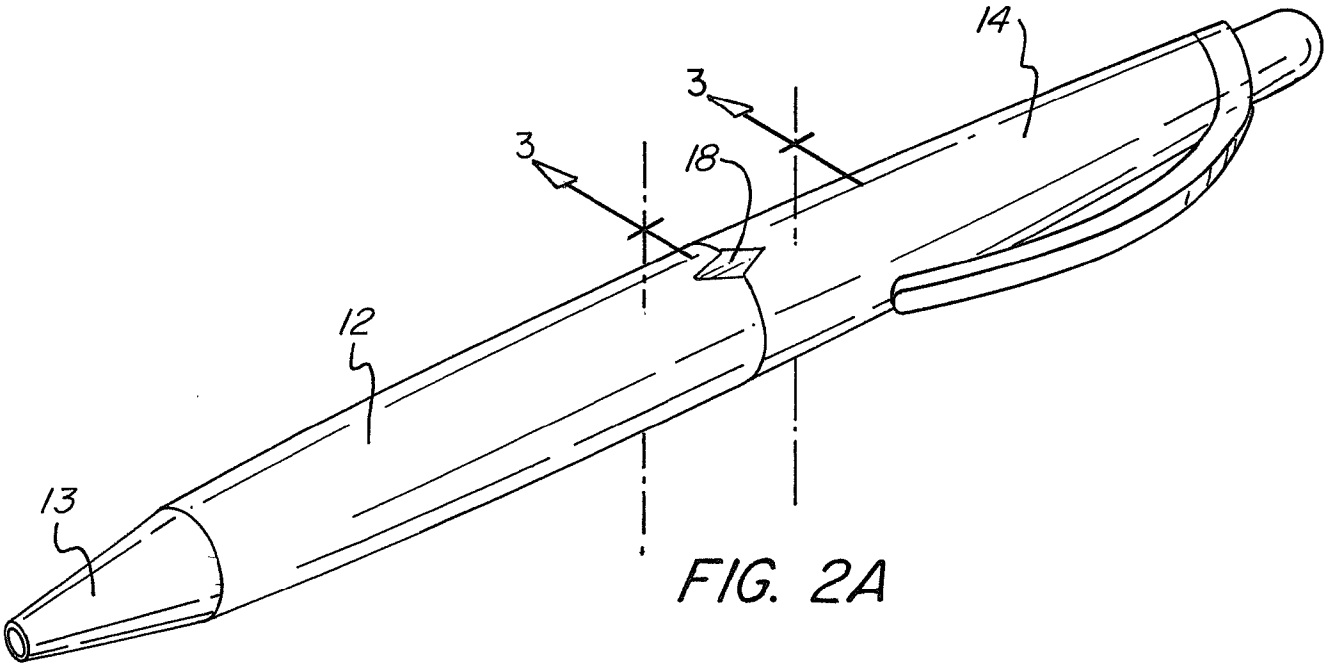
FIG. 2A is a front perspective view of the writing instrument of FIG. 1A.
Figure 2B:
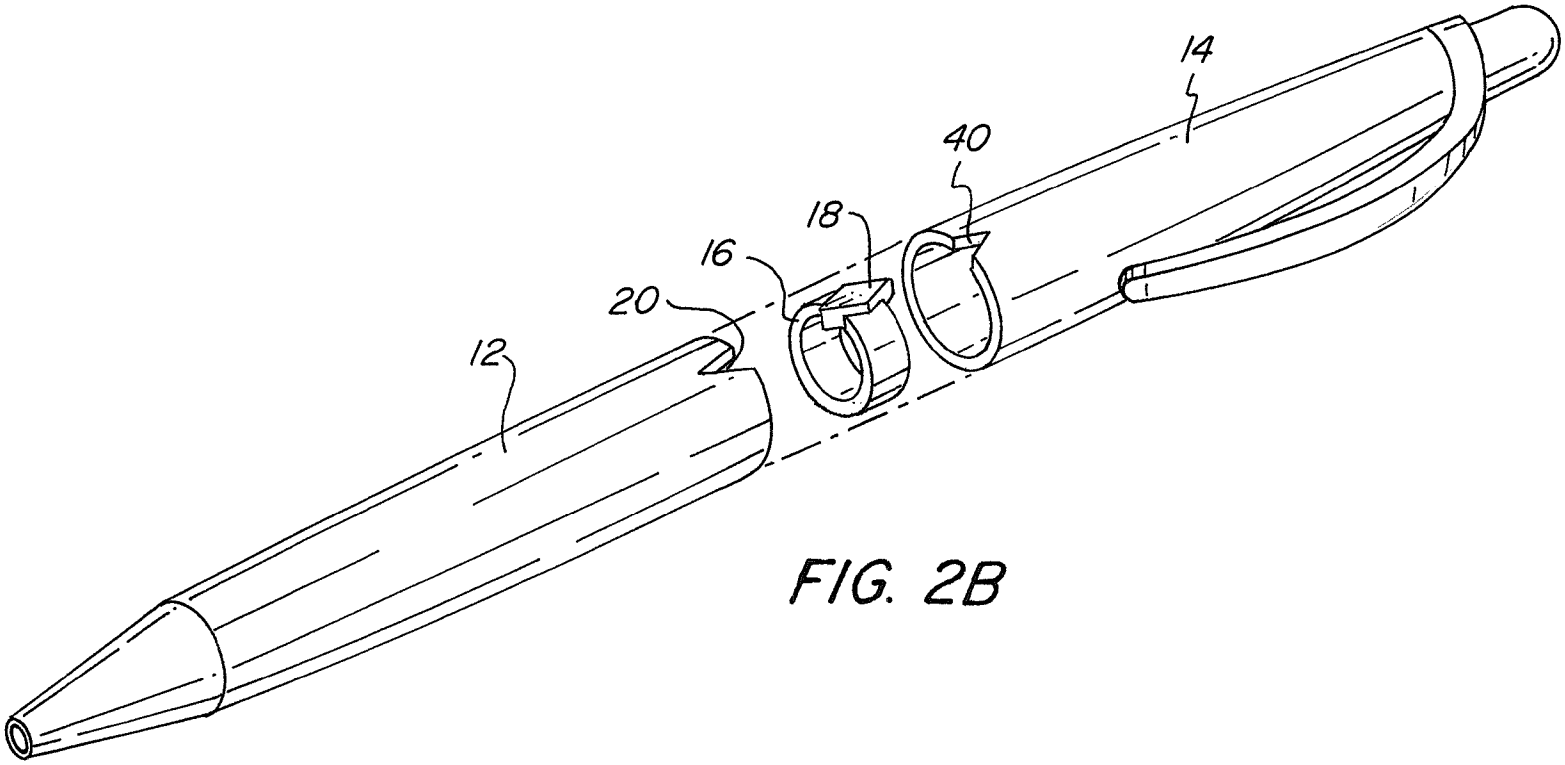
FIG. 2B is a front perspective view of the writing instrument of FIG. 2A, shown in an exploded configuration.

FIGS. 2A and 2B illustrate another exemplary embodiment of the present invention. In this embodiment, the second housing portion (14) also has a second recess (40) positioned at a terminal edge of a proximal end of the housing portion (14). The second recess (40) may have a shape that corresponds to the shape of the first recess (20) or any other desirable shape. Both first and second recesses (20, 40) are positioned such that they align with each other when the first and second housing portions (12, 14) are connected together, as shown in FIG. 2A.

As illustrated in FIG. 2B, in this embodiment, the decorative portion (18) of the decorative insert (16) has a shape that substantially corresponds to the shape of the first and second recesses (20, 40) when the recesses are aligned. When the decorative insert (18) is placed between the first and second housing portions (12, 14), as shown in FIG. 2A, the decorative portion (18) fits inside the first and second recesses (20, 40), such that only the top surface of the decorative portion (18) is visible from the outside, and the body of the decorative insert (16) is completely covered by the housing portions (12, 14).

Figure 3:
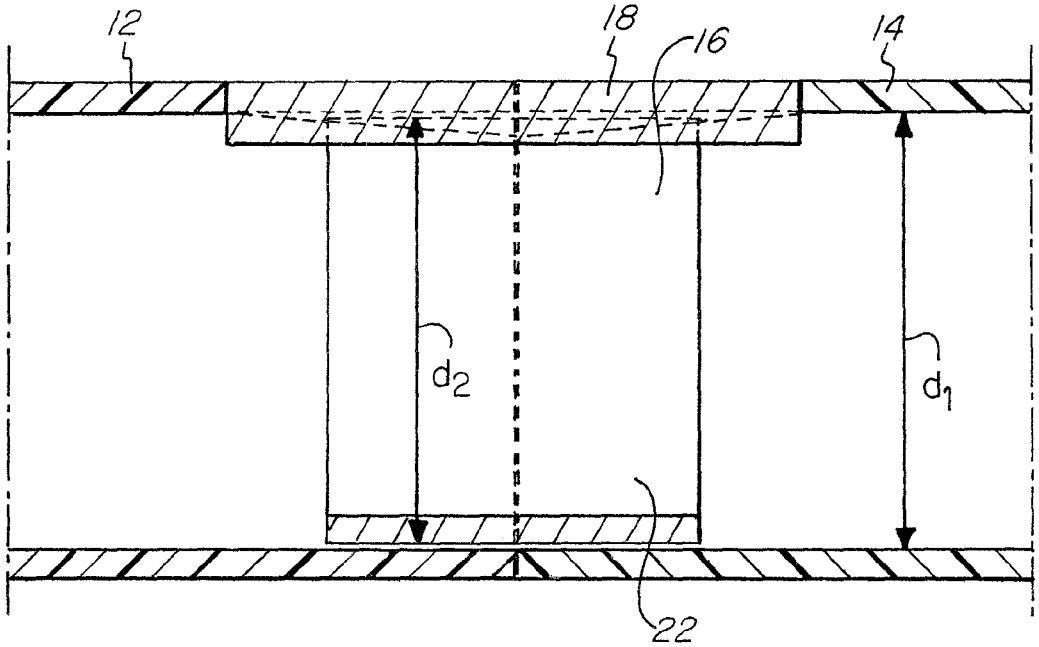
FIG. 3 is a cross-sectional view of a portion of the writing instrument of FIG. 2A, taken along the line "3-3".

FIG. 3 illustrates a cross-sectional view of the middle portion of the pen where the two housing portions (12, 14) mate when they are connected together. The decorative insert (16) is inserted inside the first and second housing portions (12, 14) such that the annular body (22) is completely covered by the housing portions and only the decorative portion (18) of the insert is visible. As shown in this figure, the housing portions (12, 14) have an inner diameter designated "d1" and the annular body (22) of the decorative insert (16) has an outer diameter designated "d2". The outer diameter "d2" of the annular body (22) is preferably slightly smaller than the inner diameter "d1" of the housing portions (12, 14) such that the annular body (22) fits tightly inside the housing portions. In some advantageous embodiments, the difference between "d1" and "d2" is in the range between about one percent to about ten percent. Such design is advantageous in that no additional parts or manufacturing processes are required to retain the decorative insert between the housing portions.

It is understood that the annular body (22) of the decorative insert may fit inside only one of the two housing portions (12, 14) and may be retained therein by the close fit between the annular body (22) and the inner wall of the housing portion. Furthermore, the close fit between the inner edge of the recesses in the housing portions and the decorative portion (18) of the insert (16) also assists in retaining the decorative insert between the housing portions.

It is further understood that the decorative insert (16) may be held inside the housing portions by other suitable fastening means. For example, the annular body (22) of the insert may be attached to the housing portions by an adhesive. In other embodiments, the housing portions and the decorative insert may be provided with mating connectors, such as snap-fit or screw on connectors, that engage when the decorative insert is placed between the housing portions. In some embodiments, the decorative insert in removably placed between the housing portions such that it can be easily removed and exchanged for a different decorative insert. In other embodiments, the decorative insert is permanently connected to one or both of the housing portions, for example, by using an adhesive.

Figure 4A:
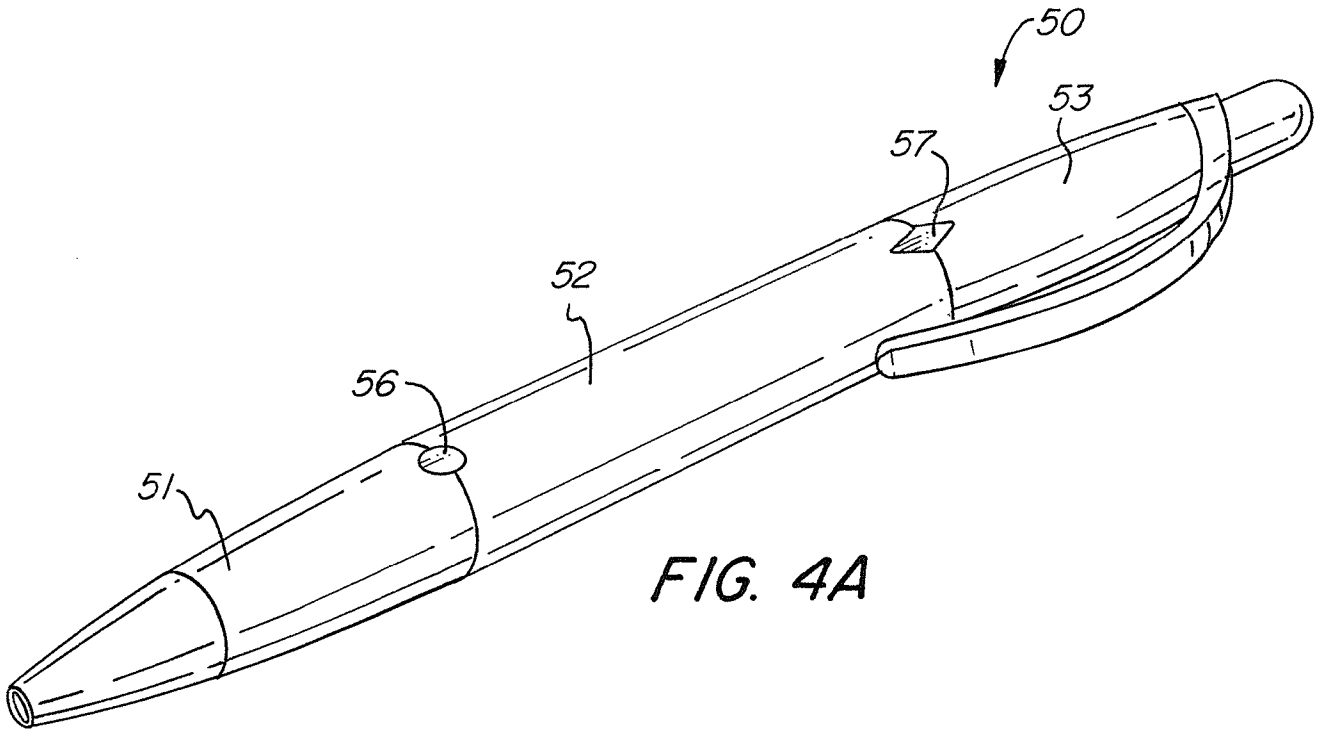
FIG. 4A is a front perspective view of the writing instrument of FIG. 1A.
Figure 4B:
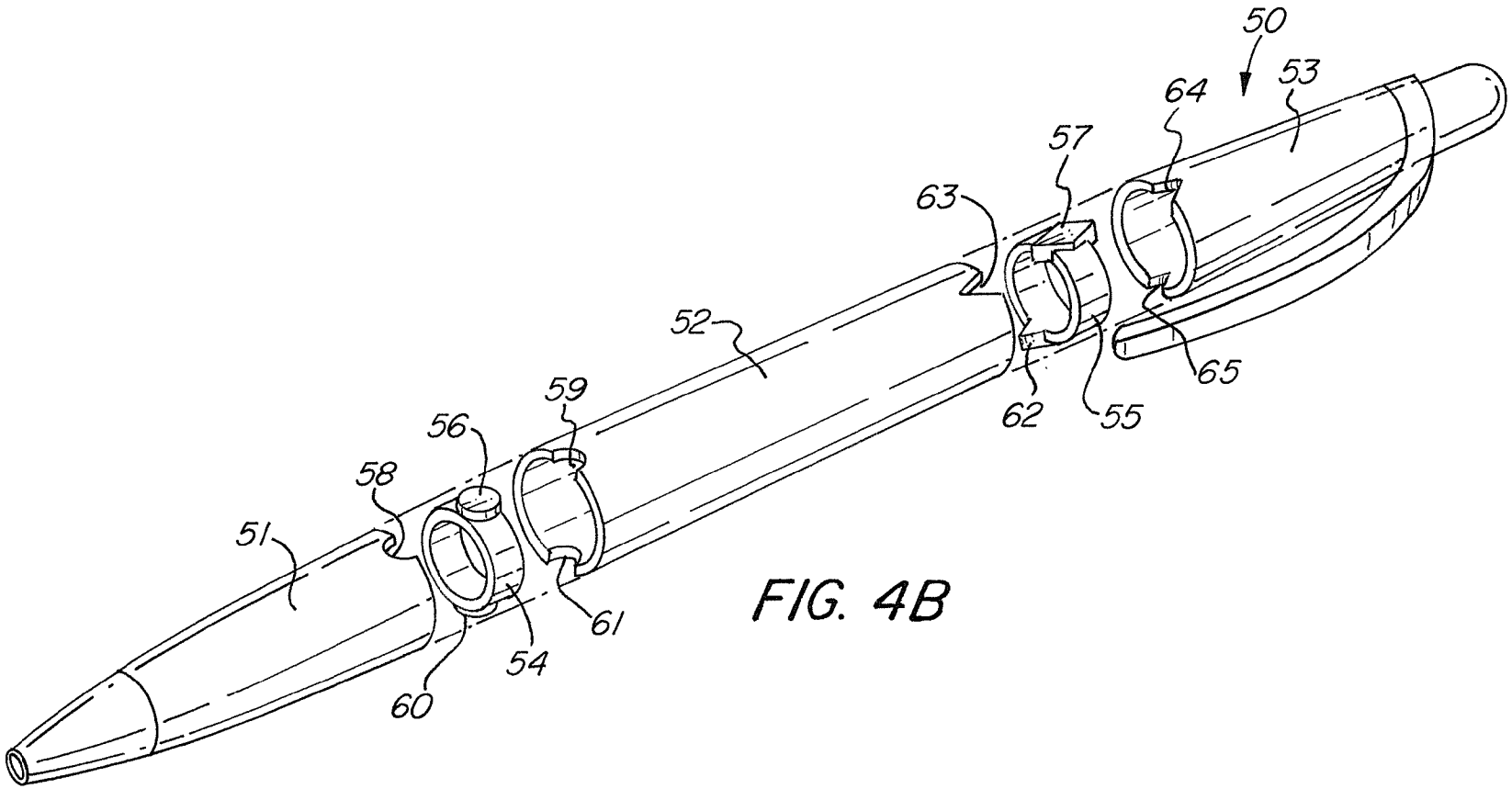
FIG. 4B is a front perspective view of the writing instrument of FIG. 4A, shown in an exploded configuration.

The decorative insert of the present invention allows for a multitude of design variations. For example, the decorative portion of the decorative insert may be made in any desirable shape and have any desirable color. Furthermore, a decorative insert may have more than one decorative portions and any number of decorative inserts may be used with a single product. FIGS. 4A and 4B show another exemplary embodiment of the present invention, wherein two decorative inserts with multiple decorative portions are positioned on the pen.

As shown in FIG. 4B, the pen (50) has a first housing portion (51), a second housing portion (52) and a third housing portion (53). A proximal end of the first housing portion (51) has two recesses (one labeled 58 and the second one not visible in this view), wherein each of the two recesses is open to the proximal end of the first housing portion. The second housing portion (52) has two recesses (59, 61) positioned at and open to its distal end and two recesses (63 and the other not visible in this view) positioned at and open to its proximal end. The third housing portion (53) has two recesses (64, 65) positioned at and open to its distal end.

The pen further includes a first decorative insert (54) positioned between the first and second housing portions (51, 52) and a second decorative insert (55) positioned between the second and third housing portions (52, 53). The first decorative insert (54) has an annular body with two decorative portions (56, 60) positioned thereon. In the exemplary embodiment shown in FIGS. 4A and 4B, the decorative portions are positioned on the opposite sides of the annular body of the insert. However, it is understood that the decorative portions may be positioned at any desired location on the annular body.

The shape of the decorative portion (56) corresponds to the shape of the recesses (58, 59) in the first and second housing portions when the housing portions are connected together such that the recesses (58, 59) align with each other. The shape of the decorative portion (60) corresponds to the shape of the other recess in the first housing portion (not shown) and the recess (61) in the second housing portion when the recessed are aligned. Similarly, the shape of the decorative portion (57) of the second decorative insert (55) corresponds to the shape of the recesses (63, 64) and the shape of the decorative portion (62) corresponds to the shape of the recess (65) and the corresponding recess in the second housing portion (not shown).

After the first and second decorative inserts (54, 55) are positioned between the respective housing portions, the decorative portions (56, 60, 57, 62) are inserted into the respective recesses (58, 59, 61, 63, 64, 65). Then, the first, second and third housing portions (51-53) are connected together such that the annular bodies of the first and second decorative inserts (54, 55) are completely covered by the housing portions and only the decorative portions (56, 60, 57, 62) are visible from the outside, as shown in FIG. 4A. When the pen (50) is completely assembled, the top surfaces of the decorative portions (56, 60, 57, 62) are flush with the outer wall of the pen housing.

As shown in FIGS. 4A and 4B, the decorative portions of the decorative inserts may have different shapes, e.g. various geometric shapes, such as circle, oval, diamond, square, etc., to give more aesthetic appeal to the overall pen design.

Referring back to FIGS. 2A and 2B, the housing portions (12, 14) may be connected together by any suitable connecting mechanism. For example, the first housing portion (12) may include a first connector (not shown) and the second housing portion (14) may include a corresponding second connector (not shown), such that the first and second connectors engage when the first and second housing portions are connected together. For example, the first housing portion may have a male screw portion and the second housing portion may have a female screw portion, or vice versa, such that the male and female screw portions engage to hold the two housing portions together. In other embodiments, a snap-fit type of connectors may be used to connect the housing portions. In yet further embodiments, an additional distal cap member (13) may be used to hold the housing portions together. The distal cap member (13) may be connected to the distal end of the first housing portion (12) by any suitable connector mechanism, such as screw-on or snap-fit connectors.

Figure 5:
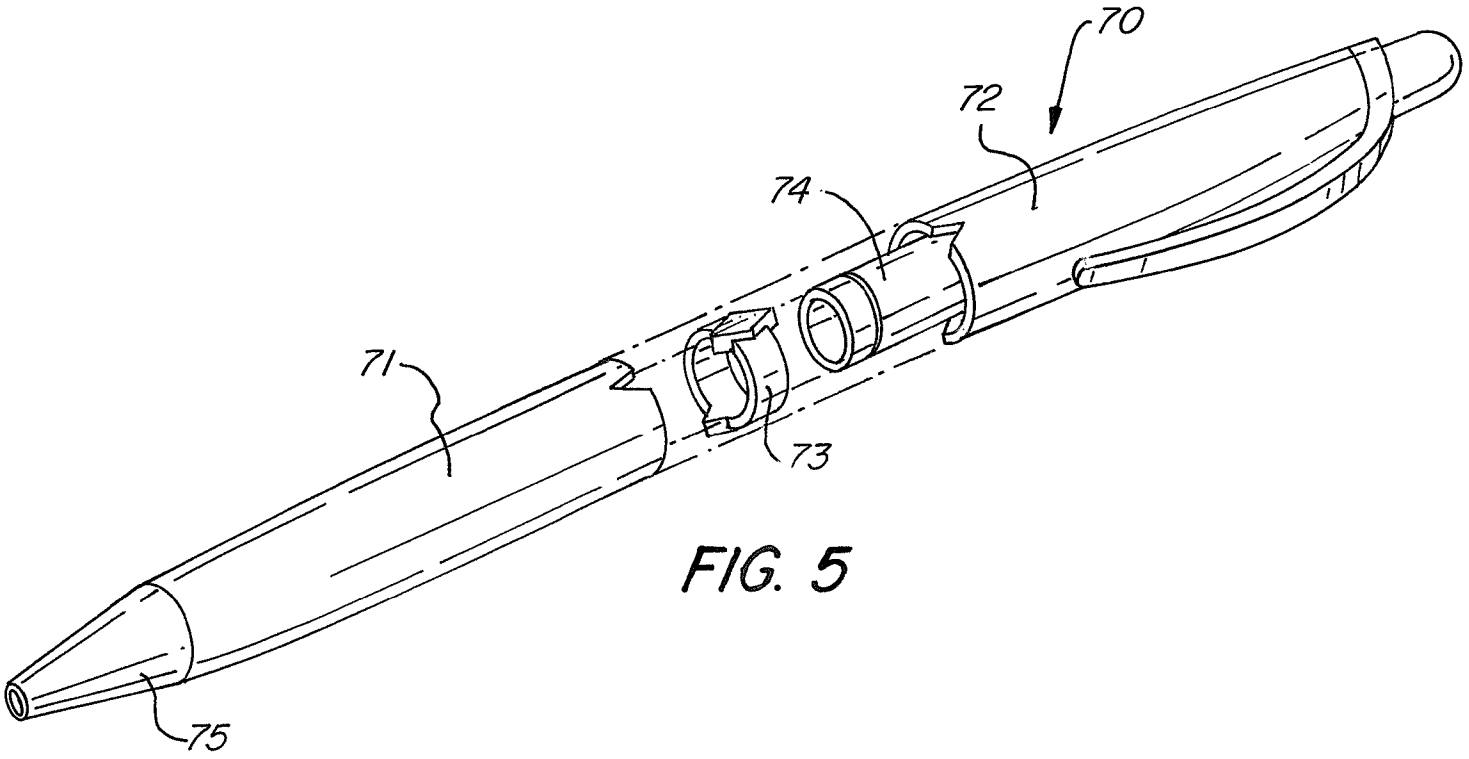
FIG. 5 is a front perspective view of the writing instrument of FIG. 1A, shown in an exploded configuration.

In another exemplary embodiment shown in FIG. 5, a second housing portion (72) includes a connector piece (74) extending from a distal end of the second housing portion. It is understood that the connector piece may instead be positioned at a proximal end of the first housing portion (71). The connector piece has a tubular body with an outer diameter that is smaller than the inner diameter of the annular body of the decorative insert (73) such that the connector piece (74) extends through the decorative insert (73) when the housing portions are connected together. The distal end of the connector piece (74) may have a connector that engages a corresponding connected provided adjacent the proximal end of the first housing portion (71). The connector piece (74) may also function to facilitate positioning and retention of the decorative insert (73) between the housing portions.

Figure 6:
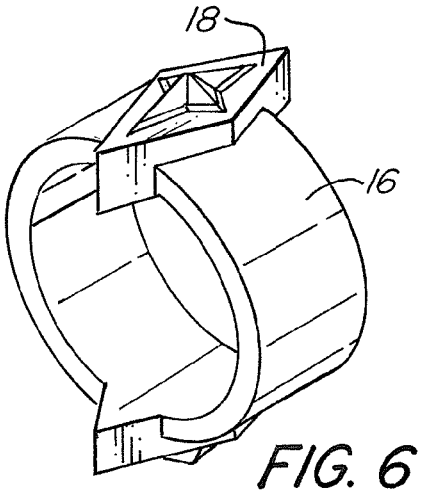
FIGS. 6-10 are front perspective views of decorative inserts of the writing instrument of FIG. 1A.
Figure 7:
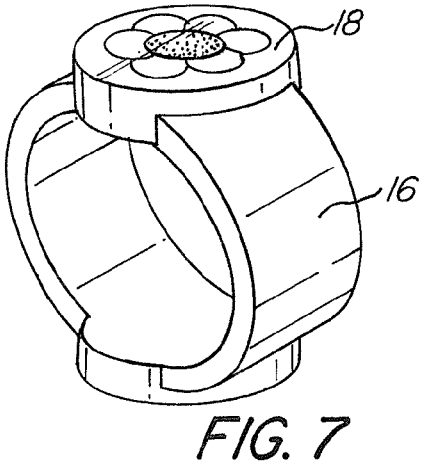
Figure 8:
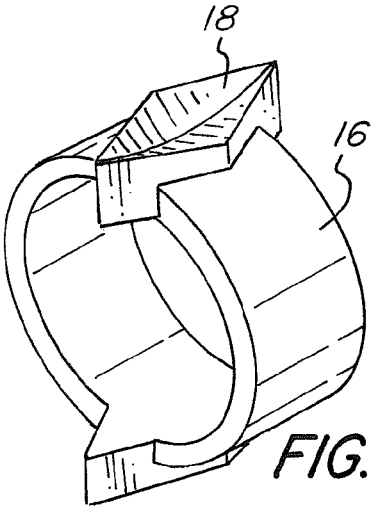
Figure 9:
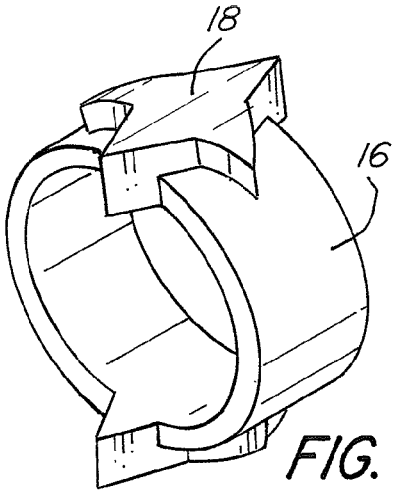
Figure 10:
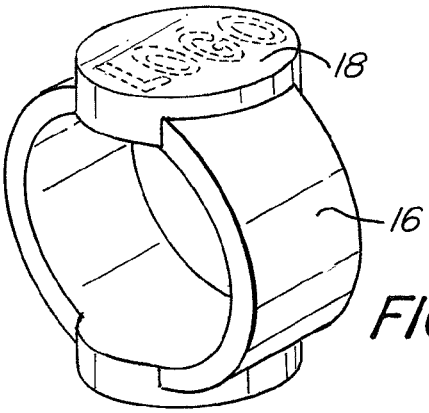

The top surface of the decorative portion (18) includes a decorative pattern. FIGS. 6-10 illustrate various exemplary embodiments of the decorative portion (18). As shown in FIGS. 6 and 8, the decorative portion (18) may include a three-dimensional pattern placed on the top surface of the decorative portion. Such pattern is produced by any known suitable technique, such as, for example, etching or three-dimensional printing. In other embodiments, such as shown in FIG. 7, the top surface of the decorative portion (18) may include a two-dimensional pattern produced by printing or any other suitable technique. In additional embodiments, the shape of the decorative portion itself may be used to provide the decorative element, such as illustrated in FIG. 9. In yet further embodiments shown in FIG. 10, the decorative portion (18) of the decorative insert (16) includes a corporate identifier or a logo.

Figure 11A:
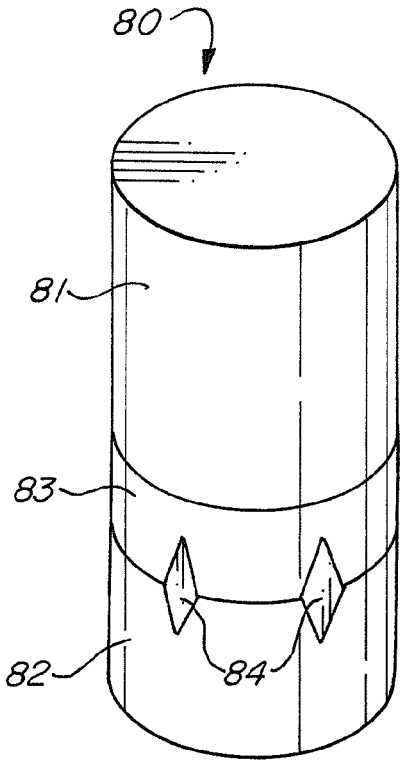
FIG. 11A is a front perspective view of a cosmetic packaging with a decorative insert in accordance with the present invention.
Figure 11B:
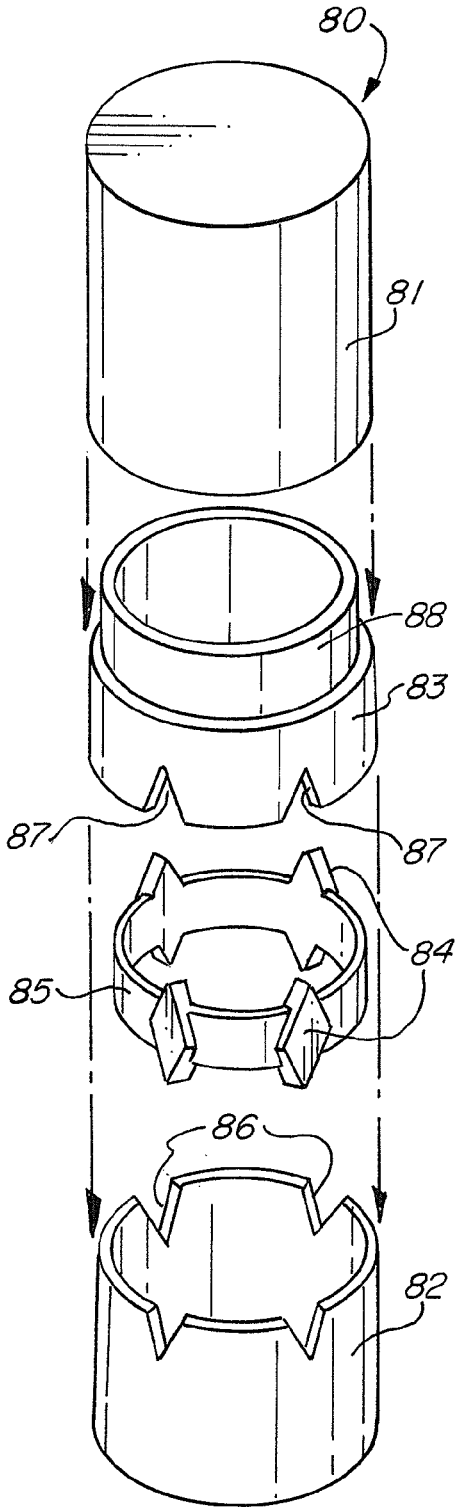
FIG. 11B is a front perspective view of the cosmetic packaging of FIG. 11A, shown in an exploded configuration.

FIGS. 11A and 11B illustrate a cosmetic product packaging, i.e. lipstick case, with a decorative insert of the present invention. The lipstick case (80) includes a base portion (82), a middle portion (83), and a cap portion (81). The lipstick case (80) further includes a decorative insert (85) that is inserted between the base portion (82) and the middle portion (83) of the case (80). The base portion includes a plurality of recesses (86) positioned at and open to the top end thereof. In the embodiment shown in FIGS.

11A and 11B, there are four recesses, each having a half-diamond shape. It is understood, however, that any number of recesses with any desirable shape may be provided. The middle portion (83) have four corresponding recesses (87) positioned at and open to the bottom end of the middle portion, such that the recesses (86) align with the recesses (87) when the base portion (82) and the middle portion (83) are connected together.

The decorative insert (85) has an annular body with an outer diameter that is smaller than the inner diameter of the base and middle portions such that the annular body fits inside the base and middle portions (82, 83). There are four decorative portions (84) positioned around the circumference of the decorative insert (85). The shape of the decorative portions (84) corresponds to the shape of the recesses (86, 87) such that the decorative portions fit within the recesses when the base and middle portions are connected together. As shown in FIG. 11A, in the assembled configuration of the lipstick case (80), only the top surfaces of the decorative portions (84) are visible and are flush with the outer wall of the case (80).

The top end of the middle portion (83) includes a connector (88) that mates with the bottom end of the cap portion (81) to retain the cap portion on the case when the lipstick is not in use. For example, the top end of the middle portion (83) may include a connector portion (88) with a reduced diameter that engages the inner wall of the bottom end of the cap portion (81). This way, the outer wall of the cap portion is flush with the outer wall of the middle portion when the cap portion is positioned on the middle portion, thereby providing a more aesthetically pleasing look. The bottom portion (82) and/or the middle portion (83) include any suitable actuator (not shown) for extending the lipstick out of the case (80) when in use.

Figure 12A:
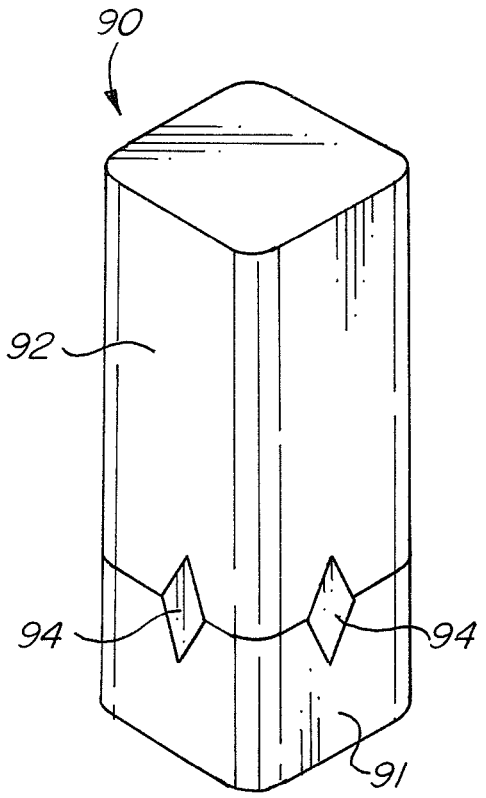
FIG. 12A is a front perspective view of a cosmetic packaging with a decorative insert in accordance with the present invention.
Figure 12B:
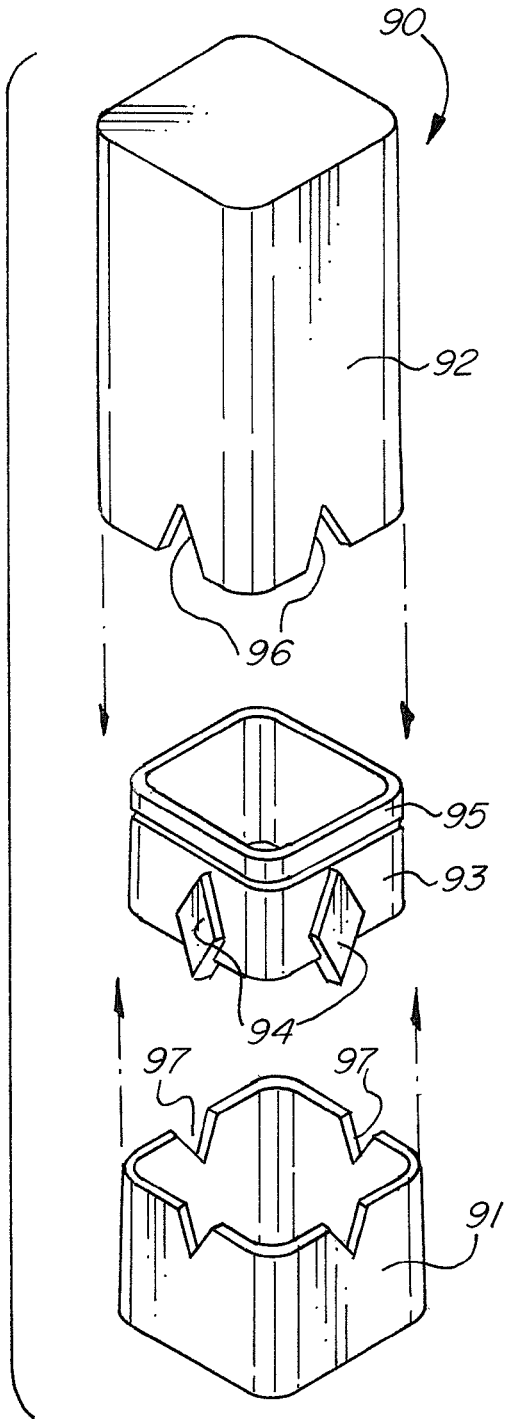
FIG. 12B is a front perspective view of the cosmetic packaging of FIG. 12A, shown in an exploded configuration.

Another type of a cosmetic product packaging—a perfume case—is illustrated in FIGS. 12A and 12B. The perfume case (90) has a bottom portion (91), a top portion (92) and a decorative insert (93) positioned between the top and bottom portions. Each of the bottom and top portions (91, 92) has a plurality of recesses (97 and 96 respectively) positioned at and open to the adjacent ends of the top and bottom portions. The decorative insert has a square shaped body that corresponds to the shape of the top and bottom portions (91, 92) and a plurality of decorative portions (94) positioned on the body. Similarly to the lipstick case described above, the decorative portions (94) have a shape that corresponds to the shape of the recesses (96, 97) such that the decorative portions (94) fit within the recesses (96, 97) when the top and bottom portions are connected together and only the top surface of the decorative portions is visible from the outside, as illustrated in FIG. 12A.

In this embodiment, the decorative insert (93) further includes a connector piece (95) positioned on the top end of the decorative insert (93). The connector piece (95) is used to retain the top portion (92) on the bottom portion (91) when the case is not in use, as shown in FIG. 12A. The connector piece (95) may be similar to the connector portion (88) described above, or may be any other suitable connector type.

One of the advantages of the decorative insert of the present invention is that the decorative inserts may be easily customized with any desirable decorative pattern and then used with already manufactured components, such as pen or cosmetic packaging components, thereby providing a custom-made but cost efficient product. Another advantage of the decorative insert of the present invention is that it is very simple in design, without requiring additional parts or manufacturing steps, thereby reducing manufacturing time and costs.

It should be understood that the foregoing is illustrative and not limiting, and that obvious modifications may be made by those skilled in the art without departing from the spirit of the invention. Although the invention has been described with reference to embodiments herein, those embodiments do not limit the scope of the invention. Accordingly, reference should be made primarily to the accompanying claims, rather than the foregoing specification, to determine the scope of the invention.

What is claimed is:

1. A writing instrument with a decorative element, comprising:

a housing having a first portion and a second portion, wherein at least one of the first and second housing portions has a recess positioned at and open to a terminal edge thereof; and a decorative insert having a body and at least one decorative portion coupled to said body such that it abuts said body, said decorative portion having a shape that substantially corresponds to the shape of said recess such that only said decorative portion is visible when said first and second housing portions are connected together;

wherein the body of said decorative insert has a continuous unbroken annular portion.

2. The writing instrument according to claim 1, wherein said recess corresponds to only a portion of a periphery of the at least one decorative portion of said decorative insert.

3. The writing instrument according to claim 1, wherein the annular portion of the body of said decorative insert has a fixed outer diameter that is smaller than an inner diameter of at least one of said first housing portion and an inner diameter of said second housing portion, such that the body of said decorative insert fits inside at least one of said first housing portion and said second housing portion.

4. The writing instrument according to claim 3, wherein the difference between the outer diameter of the annular portion and the inner diameter of at least one of said first housing portion and said second housing portion is in a range from about one percent to about ten percent.

5. A writing instrument with a decorative element, comprising:

a housing having a first portion and a second portion, wherein said first housing portion has a first recess positioned at a terminal edge thereof and said second housing portion has a second recess positioned at a terminal edge thereof such that first and second recesses align when said first and second housing portions are connected together; and a decorative insert having a body and at least one decorative portion positioned on said body, said at least one decorative portion having a shape that substantially corresponds to the shape of said first and second recesses when the recesses are aligned with each other.

6. The writing instrument according to claim 5, wherein each of said first recess and said second recess corresponds to only a portion of a periphery of the at least one decorative portion of said decorative insert.

7. The writing instrument according to claim 1, wherein the at least one decorative portion has a top surface with a decorative pattern, said top surface being flush with an outer surface of said housing when said decorative insert is positioned between said first and second housing portions.

8. The writing instrument according to claim 7, wherein the decorative pattern is printed on said top surface of said at least one decorative portion.

9. The writing instrument according to claim 7, wherein the decorative pattern is three-dimensional.

10. The writing instrument according to claim 7, wherein the decorative pattern comprises a corporate identifier.

11. The writing instrument according to claim 1, further comprising a third housing portion having a recess positioned at a terminal edge thereof, and a second decorative insert having a body and at least one decorative portion positioned on said body, wherein at least a part of said decorative portion fits into the recess in said third housing portion such that only said at least one decorative portion is visible when said second and third housing portions are connected together.

12. The writing instrument according to claim 1, further comprising a first connector provided on said first housing portion and a second connector provided on said second housing portion, wherein the first and second connectors mate when said first and second housing portions are connected together.

13. The writing instrument according to claim 1, wherein said at least one decorative portion comprises a first decorative portion and a second decorative portion positioned on said body, wherein at least one of the first and second housing portions has a first recess positioned at a terminal edge thereof and a second recess positioned at the terminal edge thereof, and wherein said first decorative portion has a shape that substantially corresponds to the shape of said first recess and said second decorative portion has a shape that substantially corresponds to the shape of said second recess such that only said first and second decorative portions are visible when said first and second housing portions are connected together.

14. A tubular member with a decorative insert, comprising:

a housing having a first portion and a second portion, wherein at least one of the first and second housing portions has a recess positioned at and open to a terminal edge thereof; and a decorative insert having a body and at least one decorative portion positioned on said body such that it abuts said body, said decorative portion having a shape that substantially corresponds to the shape of said recess such that only said decorative portion is visible when said first and second housing portions are connected together;

wherein said recess corresponds to only a portion of a periphery of the at least one decorative portion of said decorative insert, and wherein said portion of the periphery comprises less than an entire periphery of the at least one decorative portion.

15. The tubular member according to claim 14, wherein the tubular member is a writing instrument.

16. The tubular member according to claim 14, wherein the tubular member is a cosmetic product packaging.

17. A method for assembling a tubular member with a decorative element, comprising the steps of:

placing a decorative insert having a body and at least one decorative portion coupled to said body such that it abuts said body between a first housing portion of said tubular member and a second housing portion of said tubular member;

positioning said at least one decorative portion in a recess provided at and open to a terminal edge of at least one of the first housing portion and the second housing portion; and connecting said first and second housing portions together such that only said at least one decorative portion is visible.

18. The method according to claim 17, wherein said recess corresponds to only a portion of a periphery of the at least one decorative portion of said decorative insert.

19. The method according to claim 17, wherein said at least one decorative portion has a top surface with a decorative pattern, said top surface being flush with an outer surface of said housing when the decorative insert is positioned between said first and second housing portions.

20. The method according to claim 19, further comprising the step of printing the decorative pattern on said top surface of said decorative portion.

21. The method according to claim 19, wherein the decorative pattern is three-dimensional.

22. The method according to claim 19, further comprising the steps of selecting a corporate identifier having a shape that substantially corresponds to the shape of said at least one decorative portion and transferring the corporate identifier onto said decorative portion.

23. The method according to claim 17, wherein the body of said decorative insert has a continuous unbroken annular portion with an outer diameter that is smaller than an inner diameter of at least one of said first housing portion and an inner diameter of said second housing portion, and the method further comprises the step of inserting the body of said decorative insert inside at least one of said first housing portion and said second housing portion to retain the decorative insert between said first and second housing portions.

24. The method according to claim 17, wherein the tubular member further comprises a third housing portion having a recess positioned at a terminal edge thereof, and the method further comprises the steps of:

placing a second decorative insert having a body and at least one decorative portion positioned on said body between said second and third housing portions;

positioning at least a part of said at least one decorative portion in the recess provided in said third housing portion; and connecting said second and third housing portions together such that only said decorative portion is visible.

25. The method according to claim 17, wherein the step of connecting said first and second housing portions further comprises engaging a first connector provided on said first housing portion with a second connector provided on said second housing portion.

26. The method according to claim 17, further comprising the steps of:

disconnecting said first and second housing portions;

removing said decorative insert;

inserting another decorative insert having at least one decorative portion between the first and second housing portions; and connecting said first and second housing portions together such that only said at least one decorative portion is visible.

* * * * *